US008169858B2

(12) United States Patent
Klopfenstein et al.

(10) Patent No.: US 8,169,858 B2
(45) Date of Patent: May 1, 2012

(54) TIMEPIECE FITTED WITH A LIGHTING DEVICE COMPRISING AN ULTRAVIOLET LIGHT-EMITTING DIODE

(75) Inventors: François Klopfenstein, Delémont (CH); André Zanetta, Neuchâtel (CH); Emmanuel Fleury, Moutier (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 402 days.

(21) Appl. No.: 12/513,463

(22) PCT Filed: Oct. 30, 2007

(86) PCT No.: PCT/EP2007/061683

§ 371 (c)(1),
(2), (4) Date: Sep. 9, 2009

(87) PCT Pub. No.: WO2008/052989

PCT Pub. Date: May 8, 2008

(65) Prior Publication Data

US 2010/0202255 A1 Aug. 12, 2010

(30) Foreign Application Priority Data

Nov. 3, 2006 (EP) ..... 06123449.8

(51) Int. Cl.
*G04B 19/30* (2006.01)
*G04B 19/32* (2006.01)

(52) U.S. Cl. ..... 368/67; 368/226; 368/227

(58) Field of Classification Search ..... 368/67, 368/88, 223, 227, 294, 296; 116/286–289; 362/23, 26, 29, 30

See application file for complete search history.

(56) References Cited

U.S. PATENT DOCUMENTS 2,916,871 A * 12/1959 Wegner ..... 368/67
3,018,614 A * 1/1962 Brien ..... 368/224
3,224,184 A * 12/1965 Brien ..... 368/224
3,270,201 A 8/1966 Hardesty
3,681,587 A * 8/1972 Brien ..... 362/26
3,788,061 A * 1/1974 Tornquist et al. ..... 368/67

(Continued)

FOREIGN PATENT DOCUMENTS

JP 11-237484 8/1999

(Continued)

OTHER PUBLICATIONS

International Search Report issued in corresponding application No. PCT/EP2007/061683, completed Jun. 20, 2008 and mailed Jun. 30, 2009.

*Primary Examiner* — Vit Miska
(74) *Attorney, Agent, or Firm* — Griffin & Szipl, P.C.

(57) ABSTRACT

The invention relates to a timepiece (1) fitted with a glass (3) having an inside face and an outside face to the timepiece and a lighting device (4) comprising at least one ultraviolet or infrared light-emitting diode (4*a*) to illuminate at least one zone (9) integrating fluorescent and/or phosphorescent pigments of an indicator element (7) visible through the glass, characterized in that the light-emitting diode is arranged on the periphery of the glass forming a waveguide capable of diffusing the ultraviolet or infrared light, and that means for diffusing ultraviolet or infrared light (12; 13; 15; 19; 20) from the glass towards the interior of the timepiece are arranged in the path of the ultraviolet or infrared light.

16 Claims, 2 Drawing Sheets

U.S. PATENT DOCUMENTS

| | | | | |
|---|---|---|---|---|
| 3,851,460 | A * | 12/1974 | Piquerez | 368/296 |
| 4,115,994 | A | 9/1978 | Tomlinson | |
| 4,561,042 | A | 12/1985 | Wehner et al. | |
| 6,487,143 | B1 * | 11/2002 | Kaelin | 368/227 |
| 6,806,644 | B2 * | 10/2004 | Ueno et al. | 313/512 |
| 7,063,429 | B2 * | 6/2006 | Hirano et al. | 362/26 |
| 7,839,726 | B2 * | 11/2010 | Winkler | 368/67 |
| 2004/0213088 | A1 * | 10/2004 | Fuwausa | 368/228 |
| 2006/0067168 | A1 * | 3/2006 | Winkler et al. | 368/67 |

FOREIGN PATENT DOCUMENTS

| | | | |
|---|---|---|---|
| JP | 2000-105284 | A | 4/2000 |
| JP | 2003-186429 | | 7/2003 |
| JP | 2003-248445 | A | 9/2003 |
| WO | 2004/034153 | A2 | 4/2004 |

* cited by examiner

Section 1
A-B

Section 2
A-B

TIMEPIECE FITTED WITH A LIGHTING DEVICE COMPRISING AN ULTRAVIOLET LIGHT-EMITTING DIODE

This is a National Phase Application in the United States of International Patent Application No. PCT/EP2007/061683 filed Oct. 30, 2007, which claims priority on European Patent Application No. 06123449.8, filed Nov. 3, 2006. The entire disclosures of the above patent applications are hereby incorporated by reference.

TECHNICAL FIELD

The present invention relates generally to a timepiece such as a wristwatch fitted with a lighting device to illuminate an indicator element such as hands and/or index marks. More specifically, the invention relates to a lighting device comprising at least one ultraviolet, blue or infrared light-emitting diode to illuminate at least one zone integrating fluorescent and/or phosphorescent pigments of the indicator element to enhance the visibility of this in a dark environment. An ultraviolet or blue light-emitting diode is understood to be a diode with a light emission spectrum that covers wavelengths of ultraviolet or blue light in particular, such a diode being equally able to emit in the visible range, and an infrared light-emitting diode is understood to be a diode with a light emission spectrum that covers wavelengths of infrared light in particular.

TECHNICAL BACKGROUND

Watches, in which the dial and the hands are illuminated by means of an ultraviolet light source, are already known in the prior art. Various zones of the dial and hands are formed or covered by a substance that reacts to ultraviolet light and reflects this in the form of visible light back through the glass, thus allowing said zones to be seen in a dark environment.

For example, the patent document WO 2004/034153 describes a watch comprising a light-emitting diode or LED that emits light in the ultraviolet (UV) spectrum and is arranged on the inner periphery of the watch case between the dial and the glass of the watch. This LED is secured in a recess by a transparent resin that allows ultraviolet rays to pass through. By reacting with the ultraviolet rays, a so-called "luminous" material mixed with the transparent resin emits visible light. The dial and hands, also provided with this "luminous" material, are illuminated by the LED with ultraviolet and visible light at the same time, thus making it easier to read the time in a dark environment.

This type of watch, which combines a source of ultraviolet light with a luminous material requires a power supply, e.g. in the form of electric power with a battery. The power transformed by the LED into ultraviolet light will be largely dispersed with part of the ultraviolet rays escaping through the glass of the watch in the direction of the eyes of the user, which poses a risk for this person. In addition, since the respective surface of the hands and the index marks of the dial is relatively small, only a limited amount of ultraviolet light will be transformed into visible light by the "luminous" material, and this is unsatisfactory in terms of efficiency and illumination.

The patent document JP 2003-248445 describes a watch fitted with an ultraviolet light source associated with a waveguide provided under the dial of the watch. The latter is perforated by holes that may or may not be filled with a luminescent material that reacts with the ultraviolet rays in order to emit visible light, but can also allow the ultraviolet light to pass through the dial. Such a solution requires the use of a particular dial that is dedicated specifically to this application and is superposed on the waveguide, which poses a disadvantage both in terms of the method of assembly that must be adapted and in terms of the resulting thickness of the timepiece, which is then substantially greater.

Moreover, although the use of a waveguide in this type of watch allows losses to be slightly reduced by concentrating the ultraviolet light on the luminescent materials, the losses caused still remain significant, since the ultraviolet light that has not been transformed into visible light also partially escapes through the glass of the watch in the direction of the eyes of the user.

In all the cases outlined above the lighting devices comprise an LED that does not enable the time to be read in an optimum manner in a dark environment.

SUMMARY OF THE INVENTION

One of the main aims of the present invention is to remedy the aforementioned disadvantages by optimising the visibility of the indicator elements in a dark environment while assuring simplicity with respect to the dial as well as compactness with respect to the thickness of the timepiece. On this basis, it is intended to provide a timepiece according to the independent claim 1, i.e. a timepiece such as a wristwatch using the glass as waveguide is association with means enabling the diffusion of the ultraviolet or infrared light towards the interior of the timepiece to be optimised, while not requiring a special dial or additional waveguide.

Advantageous embodiments of the timepiece according to the invention are described within the framework of the dependent claims.

BRIEF DESCRIPTION OF THE FIGURES

Other features and advantages of the present invention will become clearer after reading the following detailed description of exemplary embodiments of the invention given solely by way of non-restrictive example and illustrated by the attached drawings, wherein.

DETAILED DESCRIPTION OF THE INVENTION

Figure 1:
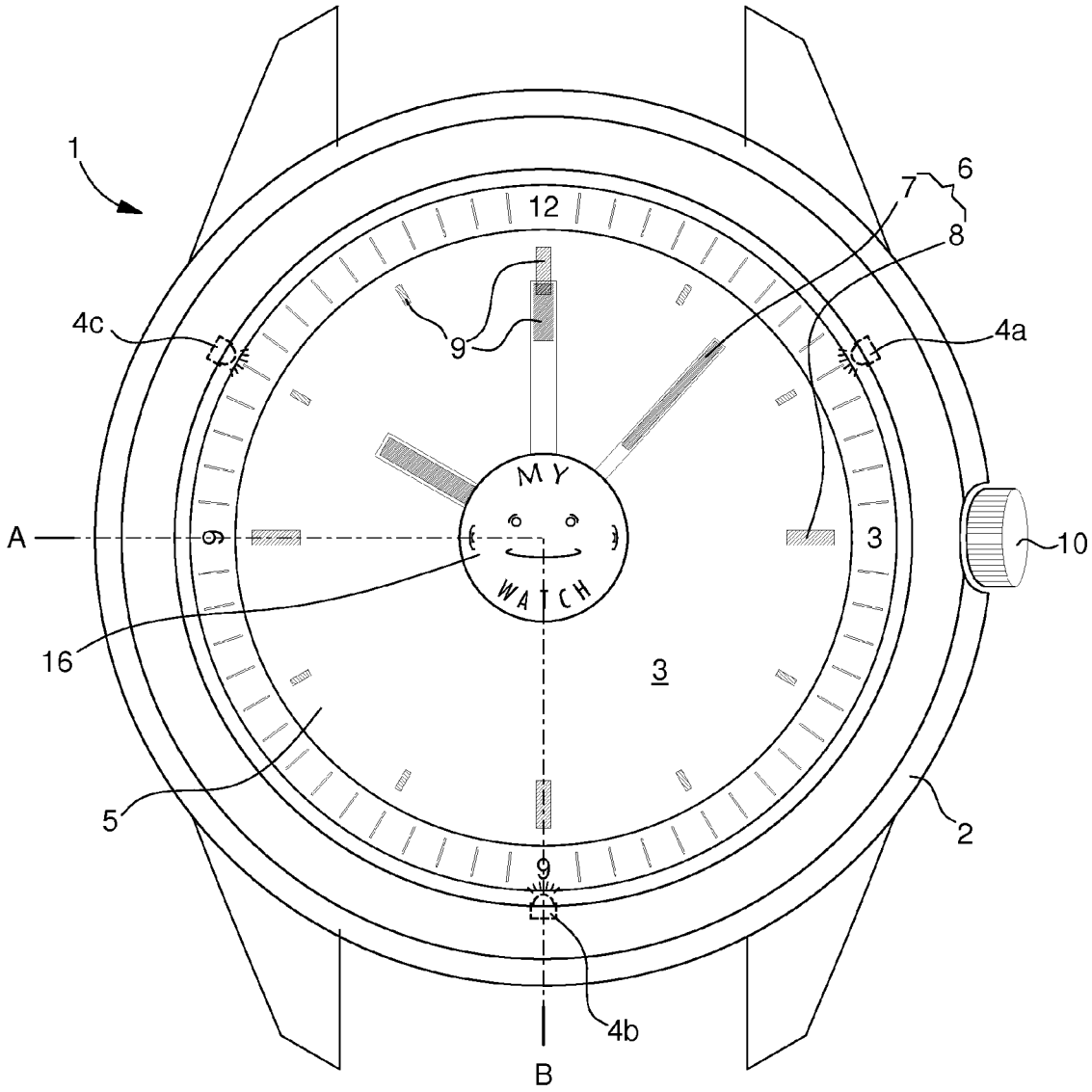
FIG. 1 is a plan view onto the timepiece in a practical example according to the present invention.
Figure 2:
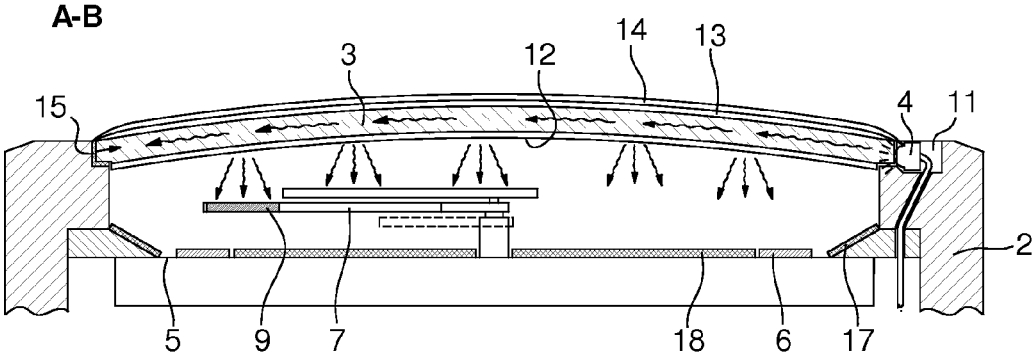
FIG. 2 schematically shows several practical examples according to the present invention of the timepiece in a section along line A-B.
Figure 3:
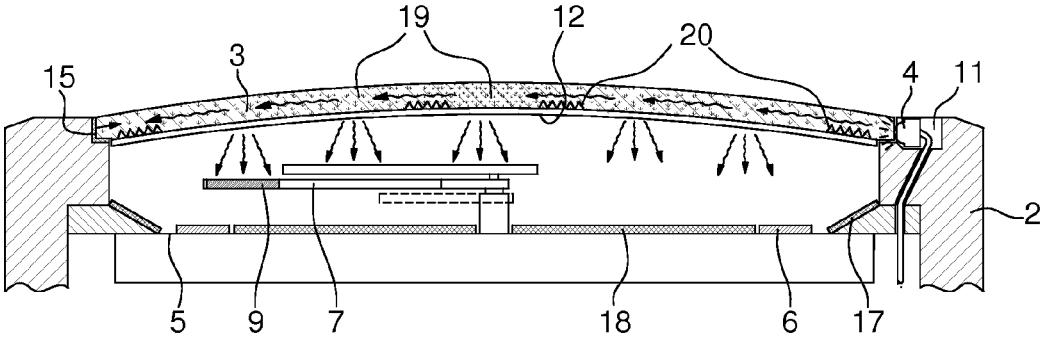
FIG. 3 schematically shows other practical examples according to the present invention of the timepiece in a section along line A-B.

The following description is provided solely by way of example and refers to FIGS. 1 to 3, in particular FIGS. 2 and 3, which show the main elements of the timepiece necessary for understanding the configuration of this according to the invention.

The timepiece 1 described here is a wristwatch comprising a watch case 2, a glass 3 closing this and a lighting device 4*a*, 4*b* and 4*c* intended to illuminate display means. The wristwatch 1 also includes other elements (not shown) necessary for its operation that we will not describe here, but which are well known to a person skilled in the art. The display means generally include a dial 5 and indicator elements 6 arranged to face this or on this, such as hands 7 and index marks 8. In the shown example, three hands 7 are provided to respectively indicate the hours, minutes and seconds, but it is of course possible to provide any predetermined number of hands 7 to cover display functions of the wristwatch 1. These hands 7 that are visible through the glass 3 of the wristwatch 1 comprise at least one zone 9 that integrates fluorescent and/or phosphorescent pigments. The dial 5 is provided with index marks 8 to indicate the hours, minutes and seconds, e.g. in the form of numbers, letters or any other predetermined sign, wherein a predetermined number of index marks 8 can also include a zone 9 that integrates fluorescent and/or phosphorescent pigments. To enable the time to be read in a dark environment, the wristwatch 1 comprises at least one ultraviolet or infrared light-emitting diode 4*a*, or ultraviolet or infrared LED, that is preferably located on the disc of the glass 3 thus serving as waveguide, which will be explained in more detail below in association with FIGS. 2 and 3. Alternatively, according to another variant (not shown), the ultraviolet or infrared LED could be located on a printed circuit under the dial, the light then being directed by means of an additional waveguide into the disc of the glass acting as waveguide. According to another variant (likewise not shown), the ultraviolet or infrared LED could be located around the periphery under the edge of the glass, this latter then being hemispherical or at least having a steeply convex curvature.

The light-emitting diode enables the zones 9 integrating the fluorescent and/or phosphorescent pigments of the hands 7 and the index marks 8 to be illuminated with the ultraviolet or infrared light, also referred to as UV or IR light. In general, a manual or automatic control element 10 is provided to activate the ultraviolet or infrared LED 4*a*. The fluorescent and/or phosphorescent zones 9 of the hands 7 and the index marks 8 are preferably formed by a translucent resin mixed with fluorescent and/or phosphorescent pigments, these reacting to the UV or IR light in order to emit visible light. The hands 7 and index marks 8 can be covered with this fluorescent and/or phosphorescent resin, for example, have recess regions filled with this or be partially made from this, to interact with a metal or synthetic support material, or can even be formed completely from the resin. This lighting device has the advantage of using an ultraviolet or infrared light, i.e. in the invisible range, and this provides a certain aesthetically pleasing effect when the hands or other indicator elements are illuminated.

Still with a view to obtaining an aesthetically pleasing effect, it can be provided that the glass is partially covered, preferably on its lower face, with a layer 16 of fluorescent and/or phosphorescent pigments in the nanometer range that allows it to remain invisible in daylight because of its very low thickness and to appear, for example, in the form of a logo or a hidden image or also in the form of hour marks when illuminated with the ultraviolet or infrared light.

We will now consider FIG. 2, which is a view taken along line A-B of FIG. 1, showing various exemplary embodiments of the present invention. The glass 3 of the wristwatch 1 forms a waveguide which is able to diffuse the UV or IR light downwards in a relatively homogeneous and uniform manner. The ultraviolet or infrared LED 4 is arranged in a receptacle 11 provided in the watch case 2 facing the disc of the glass 3 to emit the UV or IR light essentially in the plane of the waveguide. Advantageously, as shown in FIG. 1, three ultraviolet or infrared LEDs 4*a*, 4*b*, 4*c* are provided at regular intervals over the periphery of the glass, i.e. spaced at an angle essentially equal to 120°, to allow an even more homogeneous and uniform illumination to be achieved.

In order to optimise the diffusion of the ultraviolet or infrared light from the glass 3 towards the interior of the watch, means for diffusing this ultraviolet or infrared light are provided. These diffusing means allow, on the one hand, the emission of ultraviolet or infrared light to the outside of the watch, and consequently towards the eyes of the user, to be limited and, on the other hand, enable the luminous effect sought on the fluorescent and/or phosphorescent zones 9 arranged on the indicator elements 6, 7 to be increased.

According to a first variant, it is provided to deposit a diffusing layer 12 on the inside surface of the glass 3, which provides the advantage of being able to use a conventional glass while optimising the diffusion of the UV or IR light from the glass towards the inside of the watch. Examples of materials that can be used for such a diffusing layer are metal oxides such as zinc oxide or titanium oxide, for example. This diffusing layer 12 is made invisible because of its thickness in the submicron or nanometer range. The diffusion property is obtained either by control of the density of this layer or by forming a semireflective web structure consisting of forming a graduated arrangement in the submicron range of points with a variable density. The fluorescent and/or phosphorescent partial layer 16 mentioned with respect to FIG. 1 is preferably deposited between the inside face of the glass and the diffusing layer 12.

Still with the objective of diffusing the ultraviolet or infrared light from the glass towards the inside of the watch, a second variant of diffusing means consists of providing a reflective or diffusing/reflective layer 13 deposited on the upper face of the glass. Such a reflective layer is obtained by depositing a continuous and uniform layer and this is made invisible by its thickness in the submicron or nanometer range. Alternatively, such a diffusing/reflective layer is obtained by depositing a non-continuous layer, e.g. in the form of a web structure. In this variant providing a layer 13 deposited on the outside face of the glass, it is advantageously provided to deposit an additional protective layer 14 over this reflective layer. This protective layer 14 is preferably made using a sol-gel type material that assures the necessary transparent effect as well as the protective effect as a result of its hardness. This second variant has the advantage that additional layers only have to be applied to the outside of the glass, thus enabling the desired effect to be achieved without making the assembly process of the glass more complicated.

According to a third variant, the diffusing means provided consist of using a glass 3 of an optimised convex shape to direct the ultraviolet or infrared rays circulating through to the interior of the watch and more specifically onto the fluorescent and/or phosphorescent zones.

According to a fourth variant, the diffusing means provided consist of providing reflective zones 15 arranged on the disc of the glass 3 in order to keep all the ultraviolet or infrared light circulating in the glass forming a waveguide, thus preventing any absorption at the edges of the glass. It is evident that these reflective zones do not cover the disc of the glass in the area of the light-emitting diodes 4*a*, 4*b*, 4*c* arranged on its periphery. This fourth variant also has the advantage of simplicity with respect to the assembly process of the internal components of the watch.

It should be noted that in order to optimise illumination in a dark environment as well as to prevent ultraviolet or infrared rays from being emitted to the outside of the watch, while also benefiting from various advantages mentioned in relation to each of the four above-described variants, all the combinations of diffusing means corresponding to the four variants are possible and all can even be advantageously implemented to combine the effects thereof.

Still with the objective of enhancing the illumination of the fluorescent and/or phosphorescent zones 9, it is possible to provide other components inside the wristwatch such as the raised rim 17, for example, are fitted with layers or reflectors reflecting UV or IR light or to provide a layer 18 reflecting UV or IR light at least partially covering the upper face of the dial 5.

We will now consider FIG. 3, which is also a view taken along line A-B in FIG. 1. FIG. 3 shows two other variants according to the present invention of diffusing means for ultraviolet or infrared light from the glass towards the inside of the watch. These variants, which for reasons of clarity are shown separately from the four first variants shown in association with FIG. 2, can readily be combined with one another.

Thus, according to a fifth variant, the diffusing means consist of injecting a nano-powder 19 into the glass forming a waveguide. This nano-powder is composed of grains of metal oxide in the submicron or nanometer range allowing the diffusion of ultraviolet or infrared light. To achieve a homogeneous diffusion, a higher grain density is provided in the zone remote from the light-emitting diodes and a lower grain density is provided in the zone close to the diodes. This fifth variant has the advantage of not requiring a different step during the production of the glass itself and the assembly process of the watch remains a traditional one.

According to a sixth variant, the diffusing means consist of microstructures and/or nanostructures 20 formed in the glass preferably on the lower face thereof. These microstructures 20 are able to conduct UV or IR rays downwards from the glass towards the inside of the watch. As a result of their geometric arrangement and their shape these microstructures 20 can direct UV or IR rays in the direction of the fluorescent and/or phosphorescent zones 9 concerned. Advantageously, these microstructures and/or nanostructures are arranged in annular form so as not to obstruct the visibility of the indicator elements of the watch. It should be noted that their positioning on the lower face of the glass prevents them from being fouled, which would be detrimental to the optical efficiency of the glass and to the aesthetically pleasing appearance of the watch.

It should be understood that various modifications and/or improvements obvious to a person skilled in the art can be made to the above-described timepiece according to the invention without departing from the framework of the invention as defined by the attached claims. It is also possible, for example, to provide a combination of certain features of the different exemplary embodiments described above.

It is also possible to provide a luminosity detector associated with the control elements of the ultraviolet or infrared LED to activate this in a predetermined condition or to adjust the luminous intensity thereof by modulating the intensity of the electric current.

In addition, it is also possible to consider using a light-emitting diode that emits blue light, or blue LED, which allows green, yellow, orange or red light to be emitted by means of fluorescence and/or phosphorescence. In this embodiment, it is possible to at least partially cover the upper face of the glass of the timepiece with a layer reflecting blue light, which generally gives the glass a smoked appearance in daylight.

The invention claimed is:

1. A timepiece fitted with a glass having an inside face and an outside face to the timepiece and a lighting device comprising at least one light-emitting diode producing an ultraviolet, infrared or blue light to illuminate at least one zone integrating fluorescent and/or phosphorescent pigments of an indicator element visible through the glass, wherein the light emitted by the diode is directed onto the periphery of the glass forming a waveguide capable of diffusing the light, wherein means for diffusing the ultraviolet, infrared or blue light from the glass towards the interior of the timepiece are arranged in the path of said light, wherein the means for diffusing the ultraviolet, blue or infrared light are arranged in the form of at least one ring so as not to obstruct the visibility of the fluorescent and/or phosphorescent zones of the indicator element.

2. The timepiece according to claim 1, wherein the means for diffusing the ultraviolet, infrared or blue light comprise an invisible diffusing layer on the inside face of the glass.

3. The timepiece according to claim 2, wherein said diffusing layer is composed of a controlled density metal oxide coating in the nanometer range.

4. The timepiece according to claim 2, wherein said diffusing layer is composed of a metal oxide coating in the nanometer range with a semireflective web structure.

5. The timepiece according to claim 1, wherein the means for diffusing the ultraviolet, infrared or blue light comprise a nano-powder incorporated into the glass with a low density.

6. The timepiece according to claim 1, wherein the glass diffuses the ultraviolet, infrared or blue light homogeneously and uniformly towards the interior of the timepiece by means of microstructures and or nanostructures arranged on its inside face.

7. The timepiece according to claim 1, wherein the means for diffusing the ultraviolet, infrared or blue light comprise a diffusing reflective coating disposed on the outside face of the glass.

8. The timepiece according to claim 7, wherein the means for diffusing the ultraviolet, infrared or blue light additionally comprise an invisible diffusing layer between the outside face of the glass and the diffusing reflective coating.

9. The timepiece according to claim 7, wherein a layer of sol-gel material is deposited on the diffusing reflective coating to protect this.

10. The timepiece according to claim 1, wherein the means for diffusing the ultraviolet, infrared or blue light comprise a reflective coating diffusing the ultraviolet, infrared or blue light on the disc of glass except for the zone where said at least one ultraviolet, infrared or blue light-emitting diode is arranged.

11. The timepiece according to claim 1, wherein it comprises a dial, the upper face of which facing the inside face of the glass is covered at least partially with a layer reflecting the ultraviolet, infrared or blue light.

12. The timepiece according to claim 1, wherein inside the timepiece a predetermined number of its components are provided with layers and/or reflectors reflecting the ultraviolet, infrared or blue light onto the indicator elements, one of said components advantageously being the raised rim.

13. The timepiece according to claim 1, wherein the glass has a predetermined convex curvature in order to redirect the ultraviolet, infrared or blue light onto the indicator elements in a more defined manner.

14. The timepiece according to claim 1, wherein said light-emitting diode is arranged directly on the periphery of the glass forming a waveguide.

15. The timepiece according to claim 1, wherein a fluorescent and/or phosphorescent layer in the submicron or nanometer range is deposited under the inside face of the glass to allow a motif to appear when illuminated by the diode.

16. The timepiece fitted with a glass having an inside face and an outside face to the timepiece and a lighting device comprising at least one light-emitting diode producing an ultraviolet, infrared or blue light to illuminate at least one zone integrating fluorescent and/or phosphorescent pigments of an indicator element visible through the glass, wherein the light emitted by the diode is directed onto the periphery of the glass forming a waveguide capable of diffusing the light, wherein means for diffusing the ultraviolet, infrared or blue light from the glass towards the interior of the timepiece are arranged in the path of said light, wherein a fluorescent and/or phosphorescent layer in the submicron or nanometer range is deposited under the inside face of the of the glass to allow a motif to appear when illuminated by the diode.

* * * * *